US005119575A

United States Patent [19]

Gajdica

[11] Patent Number: 5,119,575

[45] Date of Patent: Jun. 9, 1992

[54] ROTARY MAGAZINE FOR FIREARMS

[76] Inventor: Michael S. Gajdica, 10700 E. Dartmouth Pl., DD201, Denver, Colo. 80014

[21] Appl. No.: 600,747

[22] Filed: Oct. 22, 1990

[51] Int. Cl.[5] ..... F41A 9/72

[52] U.S. Cl. ..... 42/19; 42/49.01

[58] Field of Search ..... 42/17, 19, 21, 49.01

[56] References Cited

U.S. PATENT DOCUMENTS

| | | | |
|---|---|---|---|
| 575,265 | 1/1897 | McClean | 42/21 |
| 580,679 | 4/1897 | Davenport | 42/21 |
| 618,369 | 1/1899 | Wilson | 42/49.01 |
| 1,115,979 | 11/1914 | Sillix | 42/19 |
| 1,420,471 | 6/1922 | Carter | 42/19 |
| 2,237,291 | 4/1941 | Carter | 42/19 |
| 4,905,395 | 3/1990 | Wagner | 42/17 |

*Primary Examiner*—Charles T. Jordan

*Attorney, Agent, or Firm*—John E. Reilly

[57] ABSTRACT

A rotary feed magazine for a pump action shotgun has circumferentially arranged chambers loaded with shells, the magazine being releasably attached to the shotgun such that the chambers can be successively rotated into alignment with a receiver chamber by a slide action cam actuator mechanism which takes the place of the conventional pump action mechanism of the gun; and when each magazine chamber is aligned with the receiver chamber the slide action mechanism will control successive advancement or feeding of the shells from the magazine chamber under the urging of a plunger. A cam is activated in response to depletion of the shells in each chamber to move into the path of movement of the cam actuated mechanism whereby to impart rotation to the magazine in order to advance the next loaded chamber in succession into alignment with the receiver chamber.

15 Claims, 3 Drawing Sheets

ROTARY MAGAZINE FOR FIREARMS

This invention relates to firearms, and more particularly relates to a novel and improved rotary feed apparatus for selectively feeding shells into the receiver chamber of a shotgun.

BACKGROUND AND FIELD OF INVENTION

Numerous approaches have been taken to automatic loading of firearms using a magazine affixed to the barrel or stock of the weapon and with cartridges stored in end-to-end relation for selective advancement into a receiver chamber. The use of a single chamber poses definite restrictions on the number of cartridges or shells that can be loaded from each magazine and this is especially true with respect to shotguns which utilize larger sized shells.

It has been proposed in the past to provide a magazine having circumferentially arranged chambers, each chamber containing shells in end-to-end relation and the chambers being rotatable into alignment with a receiver chamber for discharging the shells from each chamber into the receiver. For instance U.S. Pat. No. 4,905,395 to Wagner discloses housing sections with a plurality of shell holding chambers, the chambers being rotated by a spring member to position each loaded chamber into alignment with the receiver after which an indexing mechanism will cause the shells within each chamber to advance toward the receiver. In order to load the magazine, a turning knob in the housing must be manually engaged to wind the rotation spring so that once fully loaded the spring will have enough tension to automatically rotate each chamber in succession into alignment with the receiver.

In U.S. Pat. No. 1,420,471 to Carter a plurality of magazine tubes are successively advanced into alignment with a loading port, each tube in succession being manually rotated into alignment. Wilson U.S. Pat. No. 618,369 discloses a magazine with multiple chambers each loaded with a series of shells in tandem but which require manual rotation to bring each successive shell into alignment with a receiver.

An important consideration in an automatic loading device for firearms is the ability to maximize the number of shells which can be stored in the magazine without undue increase in size or weight of the firearm. In this regard it is important that the magazine be readily attachable to existing firearms and that the shells can be automatically advanced for successive loading into a receiver chamber in a positive, reliable manner without any special manipulation by the operator other than the usual pump action required in loading the shells into the firing chamber. In particular it is desirable that a magazine can be designed with circumferentially arranged chambers coextensive with one another, each storing a plurality of shells and each chamber is automatically advanced into alignment for loading of its shells into the receiver chamber after the preceding chamber has been emptied.

SUMMARY OF THE INVENTION

It is therefore an object of the present invention to provide for a novel and improved automatic loading mechanism for feeding shells into firearms which is positive and reliable in operation.

Another object of the present invention is to provide for a novel and improved rotary feed apparatus for selectively feeding shells into the receiver chamber of a firearm, such as, a shotgun which is compact, lightweight and fully automatic in operation.

A further object of the present invention is to provide in a rotary feed apparatus for firearms for automatic, successive rotary advancement of a series of circumferentially arranged chambers containing shells into position for automatic loading into the receiver chamber of the firearm.

A still further object of the present invention is to provide for a unitary magazine containing a series of circumferentially arranged chambers for storing and selectively ejecting or feeding cartridges or shells into the receiver chamber of a firearm and which can be positively but releasably attached to the stock of the weapon.

An additional object of the present invention is to provide for a rotary feed magazine for loading shotgun shells into the receiver chamber of a shotgun which is readily conformable for use for different gauges of pump action shotguns and which is operable in response to the pumping action required for advancing a shell from the receiver chamber into the firing chamber to automatically advance the next shell in succession into the receiver chamber.

In accordance with the present invention, a rotary feed magazine has been devised for automatically loading shotgun shells into a pump action shotgun wherein the magazine includes a plurality of circumferentially arranged chambers loaded with shotgun shells, means for releasably attaching one end of the magazine to an end wall of the receiver chamber of the shotgun such that the magazine is journaled for advancement of each chamber in succession into alignment with the receiver chamber, and a cam actuator mechanism is slidably carried on a magazine housing in surrounding relation to the magazine including release bars movable into engagement with releasable locking elements in the receiver chamber to permit a shell to be advanced from the aligned magazine chamber into the receiver chamber. Spring-loaded plunger means in each of the chambers urges each shell into succession into the receiver chamber, and cam means associated with each magazine chamber is activated in response to said plunger means to move into the path of movement of the cam actuator mechanism whereby to impart rotation to the magazine over a distance sufficient to advance the next loaded chamber in succession into alignment with the receiver chamber. In the preferred form of the present invention, the shells are normally retained within each chamber by a spring-loaded detent which is automatically retracted out of the path of movement of the shells when the associated chamber is advanced into alignment with the receiver chamber but in the retracted position will retain the plunger in the magazine chamber against accidental release. The cam means is disposed in a recess in the plunger means and, only when the plunger has reached the end of its travel in ejecting all of the shells from that chamber will the cam means spring outwardly to move into the path of travel of the cam actuator mechanism for rotation of the magazine to advance the next loaded chamber in succession into alignment with the receiver chamber.

The preferred form of cam actuator mechanism operates in place of the standard pump action mechanism to load shells successively from each magazine chamber into the receiver chamber and to rotate the magazine as described only after ejection of all the shells in each chamber.

The above and other objects, advantages and features of the present invention will become more readily understood and appreciated from a consideration of the following detailed description of a preferred form of invention when taken together with the accompanying drawings, in which:

DETAILED DESCRIPTION OF THE PREFERRED EMBODIMENT

Figure 1:
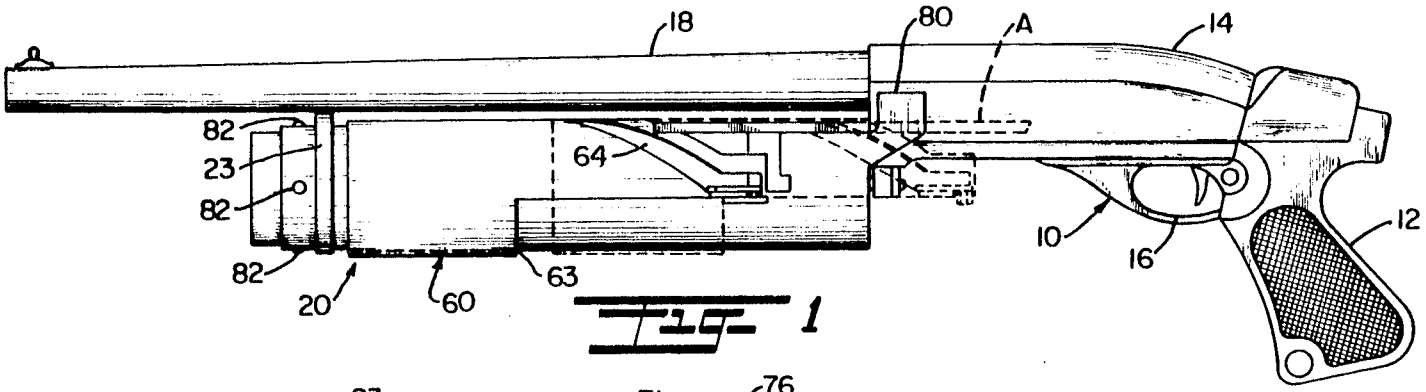
FIG. 1 is a side view in elevation of a preferred form of rotary feed apparatus for a shotgun in accordance with the present invention.
Figure 2:
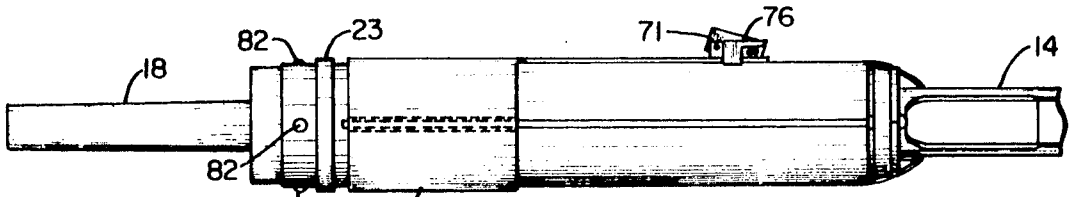
FIG. 2 is a somewhat fragmentary top plan view of the apparatus shown in FIG. 1.
Figure 10:
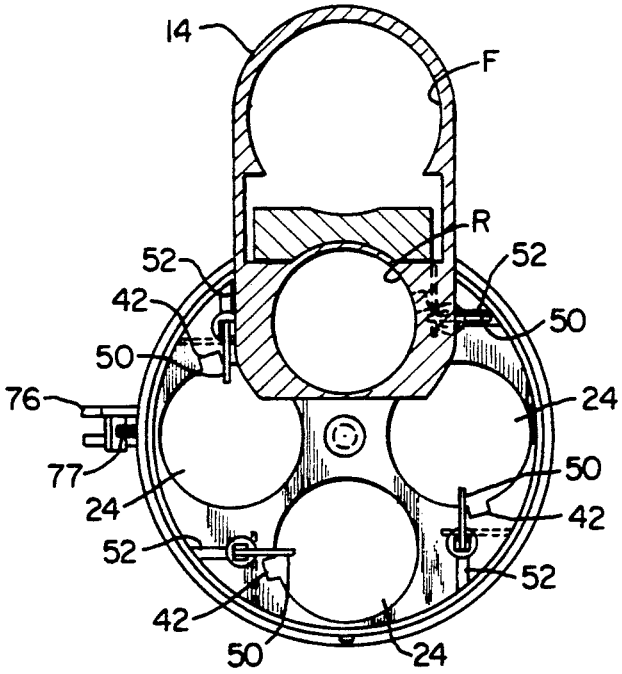
FIG. 10 is a cross-sectional view taken about lines 10—10 of FIG. 9.

Referring in more detail to the drawings, there is shown by way of illustrative example in FIGS. 1 and 2 a pump action shotgun 10 having a suitable handle or grip 12, receiver section 14, trigger assembly 16 and barrel 18. As such, the shotgun 10 is patterned after the pump action Remmington Model 870 and particularly in the construction and arrangement of the receiver section 14, trigger assembly 16 and barrel 18, but is modified to incorporate a pistol grip 12 and a rotary feed magazine as generally designated at 20 in place of the pump action magazine on the Model 870. Thus, as a setting for the present invention, the preferred form thereof will be described for use in connection with the Model 870 shotgun although it will be understood that it is readily conformable for use in other firearms, particularly of the pump action type, in which it is desirable to sequentially load a succession of shells or cartridges from a magazine into a receiver section for advancement into the firing chamber of the weapon. In this relation, the standard receiver section 14 of the weapon includes a receiver chamber as represented at R in FIG. 10 with an action bar locking block assembly, not shown, at the entrance to the chamber and which typically consists of a pair of spring-loaded dogs projecting into the chamber to normally prevent insertion of a shotgun shell therein. As illustrated in FIG. 1, release bars A extend from one end of the magazine assembly and are urged into the receiver chamber R to retract the dogs of the locking block assembly to permit a shell to be inserted therein. A suitable carrier arm, not shown, but associated with the trigger mechanism 16 is operative to advance the shotgun shell from the lower receiver chamber R into the upper firing chamber F, as illustrated in FIG. 10 at one end of the barrel 18.

Referring to FIGS. 3 to 6, a preferred form of magazine 22 is of elongated cylindrical configuration and sized for insertion into a casing 20. The magazine 22 is of solid construction with elongated bores 24 symmetrically arranged in circumferentially spaced relation about the longitudinal axis of the magazine 22. Again the magazine is sized for insertion through the casing 20 and has a projection 25 at one end for snap-fitting insertion into a clip 26 projecting downwardly from the receiver section 14 whereby the bores or chambers 24 can be successively aligned with the receiver chamber R of the receiver section. In the magazine 22 as illustrated in FIG. 3 to 6, four bores or chambers 24 are symmetrically arranged about the longitudinal axis, and a plug 28 is inserted at the front end of each bore. The opposite, rear end of each bore is left open for selective discharge of the shotgun shells S which are stored within each bore 24.

The shells S are loaded into each chamber through the open end thereof and against the urging of the coiled spring 32 mounted behind a plunger 30 in each chamber. Each plunger 30 is of generally cylindrical configuration and provided with an elongated recess 34 extending radially throughout the greater thickness of the plunger for the purpose of housing a spring-loaded lever arm 35 which is pivotally mounted as at 36 within each recess and urged in a radially outward direction by a spring element 37. The free end of each lever 35 includes a radially outwardly projecting cam 38 having an angularly directed, sloped surface portion 39.

A locating lip 40 projects radially from one side of each plunger for disposition in a longitudinally extending groove 42 communicating with the wall of each chamber 24. In this way, the plunger is free to slide axially along the chamber but fixed against rotation so that as the plunger advances toward the open end of each chamber the cam 38 will move into alignment with an aperture 44 in the outer wall of each chamber and an aligned aperture 45 in the casing 20 for a purpose to be described.

Figure 5:
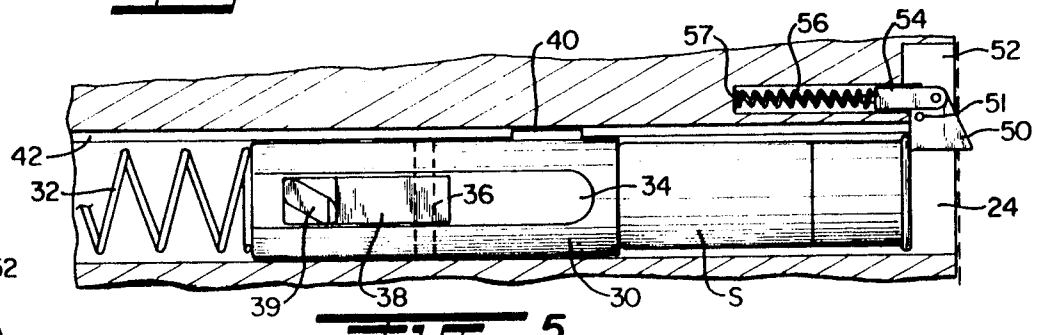
FIG. 5 is an enlarged fragmentary view illustrating the path of travel of a plunger through one of the chambers in a magazine in accordance with the present invention.
Figure 6:
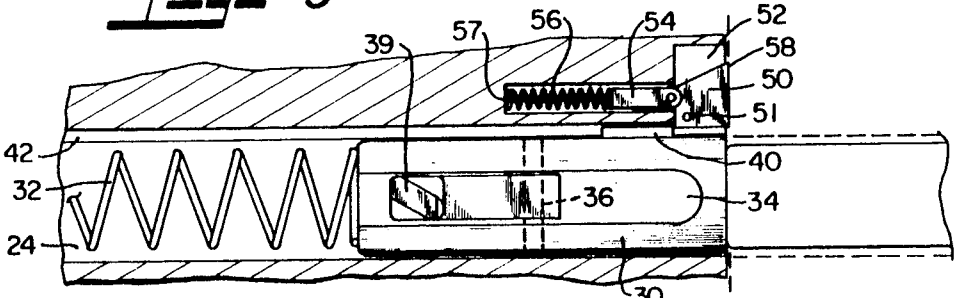
FIG. 6 is another enlarged fragmentary view similar to FIG. 5 but illustrating the plunger in its extreme position after discharging the last shell from the chamber.
Figure 4:
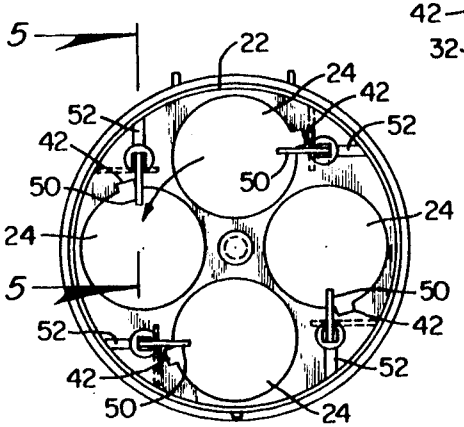
FIG. 4 is a cross-sectional view taken about lines 4—4 FIG. 3.
Figure 9:
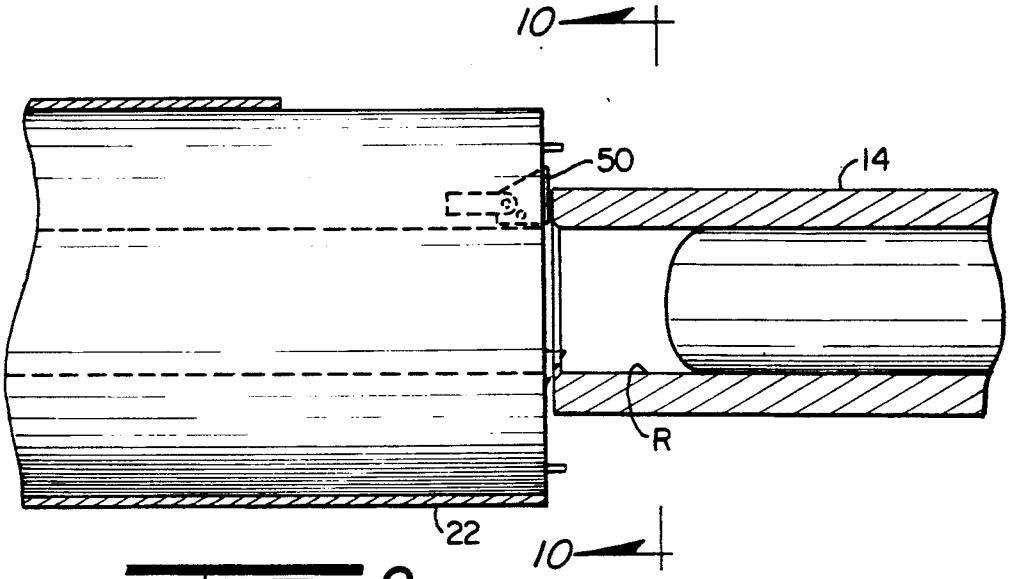
FIG. 9 is a sectional view through a receiver chamber and magazine forming a part of the rotary feed apparatus.

In order to prevent uncontrolled discharge of the shells from each chamber, a spring-loaded detent 50 in the form of a flat plate is pivotal at one corner 51 within a slot 52 which extends in a generally radially direction away from each bore or chamber 24 and through the thickness of the magazine. The control pin 54 is pivotally connected to an adjacent inner corner 55 of the detent 50 and is mounted under compression against the urging of a coiled spring member 56 within an axially extending bore 57 behind the groove 52. The detent is therefore movable under the urging of the spring 56 from a retracted position out of the path of the bore 24, as shown in FIG. 6, to an extended position into the path of movement of the shells through the bore as shown in FIG. 5. The spring force of the spring member 56 is such as to overcome the spring force behind the plunger 30.

Each detent member 50 is so positioned in relation to an associated chamber or bore 24 as to normally extend across the open end but with a corner 58 projecting beyond the open end; and when the magazine 22 is rotated in a counterclockwise direction, for example, as viewed in FIG. 10, the corner 58 will move into engagement with the outer surface of receiver section 14 which surrounds the receiver chamber R so as to be cocked in a radial outward direction, against the urging of the spring 56 and into the position shown in FIG. 6. In the retracted position of FIG. 6 the corner 58 is receded into the groove 52 when its associated chamber 24 is advanced into alignment with the receiver chamber R. Further, in this relation, it will be noted from FIG. 6 that, although the shells S will be free to advance through the open end of the chamber into the receiver chamber R, once the last shell S has been ejected, the rib 40 on the plunger 30 will move into engagement with the inside corner of the detent member 50 adjacent to the pivot 51.

Figure 8:
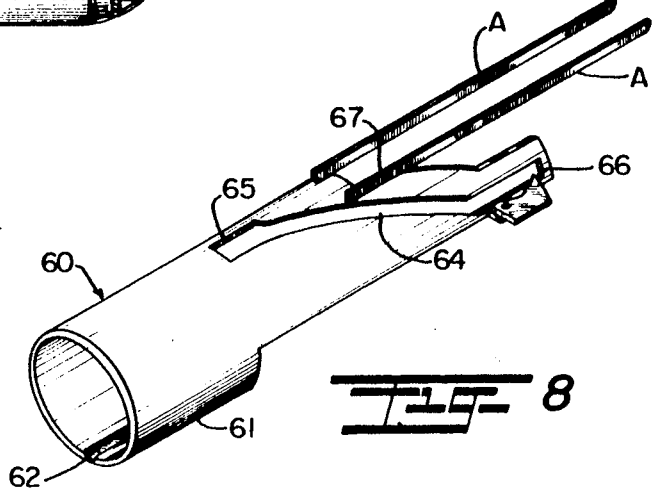
FIG. 8 is a somewhat perspective view of a preferred form of cam actuator sleeve forming a part of the rotary feed apparatus of the present invention.
Figure 7:
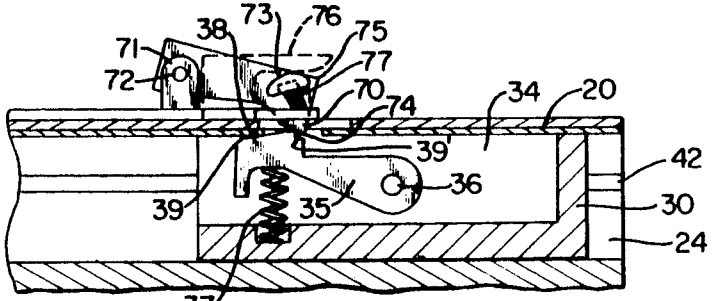
FIG. 7 is a fragmentary sectional view illustrating the interengagement between a cam member associated with the plunger and a portion of the cam actuator sleeve after the magazine has been advanced through a quarter revolution.
Figure 3:
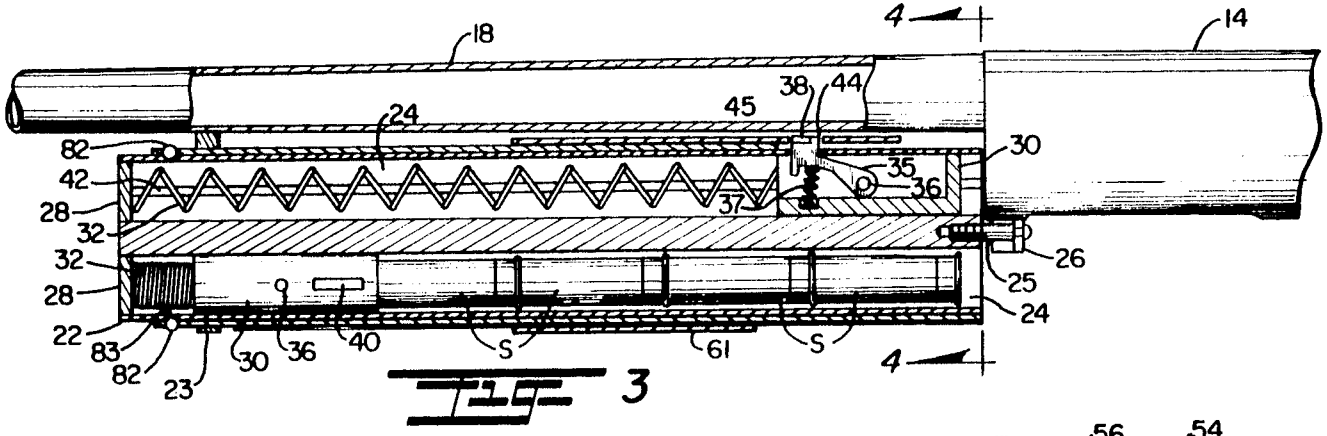
FIG. 3 is an enlarged fragmentary view partially in section of the preferred form of apparatus in accordance with the present invention.

Referring in particular to FIG. 8, a preferred form of rotary feed control sleeve 60 is sized for disposition onto the housing or casing 20 for movement between a forward position as illustrated in full in FIG. 1 to a rearward position as illustrated in dotted form. In moving rearwardly toward the receiver section 14, as noted earlier, the action bars A extend into the receiver chamber R to permit insertion of each shell in succession from the aligned chamber or bore 24 of the magazine. To this end, the sleeve 60 includes a tubular section 61 at its forward end with an internal groove 62 extending in an axial or longitudinal direction to receive a downwardly projecting, locating rib 63 on the underside of the casing 20 so that the actions bars A are properly oriented with respect to the receiver chamber; also, rib 63 aligns an inclined or generally spirally extending cam follower groove 64 on the upper surface of the sleeve 60 with respect to the cam 38 of the plunger which is aligned with the receiver chamber R. Thus, the cam follower surface 64 includes a forwardmost, longitudinally extending recessed portion 65 which communicates with one end of the curved section 64, and the curved section continues over a quarter revolution into a rearwardmost axially directed recessed portion 66. The actions bars A extend rearwardly in closely spaced parallel relation to one another from fixed end portions 67 on the external surface of the sleeve 60. Briefly, when the sleeve 60 is grasped by the operator and advanced rearwardly to cause the action bars A to advance through the receiver chamber R, a shotgun shell S is urged rearwardly out of the open end of the magazine chamber 24 into the receiver chamber by the plunger 30. Assuming that the last shotgun shell has been released from the chamber, the plunger 30 will have advanced into the position illustrated in FIG. 3 so that the cam 38 is free to spring outwardly through the aperture 44 into the recessed end 65 of the cam follower 64. When the sleeve 60 is then returned to its original full line position, the cam 38 will ride along the cam surface 64 and into the recessed end 66 thereby rotating the magazine 90° to advance the next chamber in succession into alignment with the receiver chamber. As best seen from FIG. 7, as the cam 38 advances through the recessed end 66 it will advance beneath a keeper arm 70 which is pivotally secured to bracket 71 on the external surface of the sleeve member 60 by a pivot pin 72. The arm 70 is provided with an extension pad 73 which moves into engagement with bevelled undersurface face 75 of support arm 76 whereby to urge the pointed end 70 downwardly against the sloped surface 39 of the cam 38 to push the cam 38 into the retracted position shown in FIG. 7. At the beginning of the next stroke when the sleeve 60 is advanced rearwardly, the pad 73 will clear the extension leg of the support 76 and the return spring 77 will cause the arm 70 to spring outwardly in preparation for the next cycle. In this way, as the sleeve member 60 continues to slide forwardly, the lower pointed end 74 of the dog will slide into engagement with the rearward notched edge 31 of the cam member 38 causing it to be advanced forwardly beneath the wall of the casing 20, as shown in FIG. 7. Again, as the next chamber in succession is advanced into alignment with the receiver chamber, the detent 50 will be retracted away from its respective chamber. After all of the chambers 24 have been emptied, it will be recognized that the cam members 38 will be in the retracted position shown in FIG. 7 so that the magazine can be removed for the casing 20 by releasing the clip 25 and withdrawing forwardly out of the casing 20. The next magazine may then be inserted and clipped into position by advancing the element 25 into snap-fitting engagement with the clip 26.

In the assembly of the preferred form of rotary feed mechanism, the magazine casing 20 is preassembled with the outer sleeve 60 in position and inserted through the support ring 23 which is affixed to the front end of the barrel 18. The rear end of the casing is affixed by means of extension wings 80 to opposite sides of the receiver section 14 so that the release bars A are properly aligned for advancement through the receiver chamber R as described. The sleeve 60 is properly aligned by inserting the rib 63 on the casing 20 into the longitudinal groove 62 of the sleeve with the release bars A clearing the end of the receiver chamber so as to be in the forwardmost position as illustrated in FIG. 1.

Each magazine chamber is loaded by retracting the associated detent 50 away from the chamber 24 and inserting the shells S in end-to-end relation against the urging of the plunger. Typically, for a 12 gauge shotgun each chamber 24 may retain 4 or 5 shells depending on its length. Once the chamber is fully loaded the detent is then released to move against the rearwardmost shell, and the remaining chambers 24 are loaded in the same manner. The magazine 22 is inserted through the front end of the housing or casing 20 and its attaching pin 25 inserted into snap-fit relation to the clip 26. The front end of the casing 20 includes a spring-loaded bearing 82 which is engagable with one of the depressions 83 on the external surface of the closed end of the magazine which projects forwardly beyond the casing 20. The magazine 22 is rotationally aligned by the bearing 82 in one of the depressions 83 such that one of its chambers 24 is coaxially aligned with the receiver chamber R. Care should be taken in the initial assembly to assure that the detent 50 for the magazine chamber 24 so aligned with the receiver chamber R has been retracted out of the path of movement of the shells from that chamber.

In firing the weapon, the sleeve 60 is manually grasped and axially advanced toward the receiver chamber to cause the release bars A to clear the receiver chamber for movement of a shell S under the urging of an associated plunger 30 into the chamber. The sleeve 60 is then reversed and returned to its forwardmost position whereupon the shell is advanced from the receiver chamber R into the firing chamber.

When the last shell in the chamber 24 has been ejected into the receiver, the cam 38 on the plunger 30 will spring outwardly into the recessed end portion 65 of the cam surface 64 so that forward movement of the sleeve will cause rotation of the magazine over an interval or number of degrees sufficient to cause the next loaded chamber to move into alignment with the receiver chamber. Assuming that there are four chambers symmetrically arranged about the longitudinal axis of the magazine, the cam surface will impart rotation through 90° until the cam member 38 moves into engagement with the arm 70 at the recessed end 66. The cam is then depressed in a radially inward direction and carried forwardly by the arm 70 to a position beneath the casing 20; at the same time the detent 50 will spring back into position across the end of the chamber and bear against the end of the plunger 30 to prevent its accidental release from the chamber 24; and the bearing 82 will have advanced into engagement with the next depression 83 to yieldingly resist any turning of the magazine 22 until the cam 38 is once again rotated by the sleeve 60. After all chambers 24 in the magazine have been emptied, the magazine is released by disengaging the connecting clip 26 and removing the magazine 22 through the front end of the casing 20 and replacing with a loaded magazine.

It will be evident from the foregoing that the rotary feed mechanism of the present invention is positive in operation and requires no special manipulation on the part of the operator other than to employ the normal pumping action in loading shells from the magazine into the receiver. Accordingly the mechanism is not only positive in operation but extremely compact and lightweight while offering maximum capacity for automatic firing purposes. It is to be understood that while a preferred embodiment of the present invention is herein set forth and described, various modifications and changes may be made in the construction and arrangement of elements without departing from the spirit and scope of the present invention is defined by the appended claims and reasonable equivalents thereof.

I claim:

1. In a magazine for loading cartridges into a receiver chamber of a pump action shotgun wherein a plurality of circumferentially arranged chambers in said magazine are aligned with the longitudinal axis thereof, each magazine chamber loaded with shells in end-to-end relation to one another, and means are provided for releasably attaching one end of said magazine to an end wall of said receiver chamber such that said magazine is journaled for rotation about its longitudinal axis for advancement of each magazine chamber in succession into alignment with said receiver chamber in order to advance each shell in succession from each said magazine chamber into said receiver chamber, the combination therewith comprising:

a cam actuator mechanism mounted for slidable movement axially with respect to said magazine, said mechanism including a cam follower extending at an angle to said longitudinal axis of said magazine;

plunger means associated with each of said magazine chambers for advancing each shell in succession into said receiver chamber; and cam means movable into the path of movement of said cam follower to impart rotation to said magazine advancing each loaded magazine chamber in succession into alignment with said receiver chamber.

2. In a magazine according to claim 1, each said magazine chamber being of generally tubular configuration and open at one end in facing relation to said receiver chamber, a detent member disposed at said open end of each said chamber including biasing means urging said detent to a position preventing the movement of shells therethrough, said detent movable out of the path of said shells in response to rotation of a respective chamber into alignment with said receiver chamber.

3. In a magazine according to claim 2, said plunger means including means urging said shells in a direction toward the open end of each respective magazine chamber, said biasing means for said detent normally overcoming the urging of said plunger means to prevent discharge of said shells from said magazine chambers.

4. In a magazine according to claim 3, said plunger means including a return spring yieldably urging said plunger means toward said open end of each respective magazine chamber.

5. In a magazine according to claim 1, said cam means disposed in a recess in said plunger means and including biasing means for yieldably urging said cam means in a radial outward direction through an opening in an external wall of said magazine surrounding said magazine chambers.

6. In a magazine according to claim 1, said cam follower being of generally spiral configuration extending over a 90° interval of said magazine for rotation of said magazine through a one quarter revolution.

7. In a magazine according to claim 6, means at one end of said cam follower for depressing said cam means in a radial inward direction at the end of its travel through one quarter revolution.

8. In a magazine for loading cartridges into a receiver chamber of a pump action shotgun wherein a plurality of circumferentially spaced chambers in said magazine are symmetrically arranged about the longitudinal axis thereof, each chamber loaded with shells in end-to-end relation to one another, means releasably attaching one end of said magazine to an end wall of said receiver chamber such that said magazine is journaled for rotation about its longitudinal axis for advancement of each said magazine chamber in succession into alignment with said receiver chamber, in order to advance each shell in succession into said receiver chamber, the combination therewith comprising:

a cam actuator mechanism mounted for slidable movement axially with respect to said magazine, said mechanism including release bars movable into said receiver chamber, and a cam track extending at an angle to said longitudinal axis of said magazine;

plunger means associated with each of said magazine chambers for advancing each shell in succession into said receiver chamber; and cam means activated in response to said plunger means in each of said magazine chambers ejecting the last shell into said receiver chamber for advancing into the path of movement of said cam track to impart rotation to said magazine advancing a next loaded chamber in succession into alignment with said receiver chamber.

9. In a magazine according to claim 8, said plunger means including a return spring yieldably urging said plunger means toward said open end of each respective magazine chamber, said cam means disposed in a recess in said plunger means and including biasing means for yieldably urging said cam means in a radial outward direction through an opening in an external wall of said magazine surrounding said chambers, and means at one end of said cam track for depressing said cam means in a radial inward direction at the end of its travel.

10. In a weapon having a receiver chamber for loading shells into a firing chamber, the combination therewith comprising:

a magazine housing mounted in fixed relation to said weapon including cam actuating means mounted for slidable movement axially with respect to said housing;

a magazine mounted for rotation within said housing, said magazine including a plurality of circumferentially arranged chambers loaded with shells in end-to-end relation to one another;

means for urging said shells in each said magazine chamber toward said receiver chamber; and cam means associated with each said magazine chamber and movable into engagement with said cam actuating means when the last of said shells is ejected from said associated magazine chamber into said receiver chamber.

11. In a weapon according to claim 10, said cam actuating means including means for moving said cam means out of the path of movement of said cam actuating means after each loaded chamber is advanced into alignment with said receiver chamber.

12. In a weapon according to claim 10, said cam actuating means including a cam surface of spiral configuration, and axially extending recessed portions at opposite ends of said cam surface.

13. In a weapon according to claim 10, said shell-urging means in each said magazine chamber defined by a spring-loaded plunger, and cam means including a spring-loaded lever arm having a cam surface at a free end thereof, and means urging said lever arm in a radial outward direction from said plunger, said cam means activated in response to said plunger means in each of said chambers ejecting the last shell into said receiver chamber for advancing into the path of movement of said cam surface to impart rotation to said magazine advancing a next loaded chamber in succession into alignment with said receiver chamber.

14. In a weapon according to claim 10, each said magazine chamber being of generally tubular configuration and open at one end in facing relation to said receiver chamber, a detent member disposed at said open end of each said chamber including biasing means urging said detent to a position preventing the movement of shells therethrough, said detent movable out of the path of said shells in response to rotation of a respective chamber into alignment with receiver chamber.

15. In a weapon according to claim 14, said biasing means for said detent normally overcoming the urging of said plunger means to prevent discharge of said shells from said magazine chambers.

* * * * *